US009269560B2

(12) United States Patent
Klumpp et al.

(10) Patent No.: US 9,269,560 B2
(45) Date of Patent: Feb. 23, 2016

(54) METHODS FOR PRODUCING AN ELECTRICALLY CONDUCTIVE MATERIAL, ELECTRICALLY CONDUCTIVE MATERIAL AND EMITTER CONTAINING ELECTRICALLY CONDUCTIVE MATERIAL

(75) Inventors: Maike Klumpp, Weiden (DE); Sven Linow, Darmstadt (DE)

(73) Assignee: Heraeus Noblelight GmbH, Hanau (DE)

( * ) Notice: Subject to any disclaimer, the term of this patent is extended or adjusted under 35 U.S.C. 154(b) by 47 days.

(21) Appl. No.: 14/237,211

(22) PCT Filed: Jul. 4, 2012

(86) PCT No.: PCT/EP2012/002800

§ 371 (c)(1),
(2), (4) Date: Feb. 5, 2014

(87) PCT Pub. No.: WO2013/020620

PCT Pub. Date: Feb. 14, 2013

(65) Prior Publication Data

US 2014/0191651 A1 Jul. 10, 2014

(30) Foreign Application Priority Data

Aug. 5, 2011 (DE) ..... 10 2011 109 578

(51) Int. Cl.
*H01K 1/14* (2006.01)
*H01K 9/00* (2006.01)
(Continued)

(52) U.S. Cl.
CPC .. *H01K 1/06* (2013.01); *H01K 3/02* (2013.01); *H05B 3/0033* (2013.01); *H05B 3/146* (2013.01); *H05B 2203/017* (2013.01)

(58) Field of Classification Search
CPC ..... H01K 1/06; H01K 3/02; H05B 3/146; H05B 3/0033; H05B 2203/017
USPC ..... 445/20, 32, 46–51; 313/315–316
See application file for complete search history.

(56) References Cited

U.S. PATENT DOCUMENTS 248,437 A 10/1881 Edison
487,046 A 11/1892 Clegg
(Continued)

FOREIGN PATENT DOCUMENTS

DE 2305105 A1 8/1974
DE 102005018268 A1 10/2006
(Continued)

OTHER PUBLICATIONS

Howell et al, "History of the Incandescent Lamp," The Maqua Company, Schenectady, NY (1927).
(Continued)

*Primary Examiner* — Anne Hines
*Assistant Examiner* — Jose M Diaz
(74) *Attorney, Agent, or Firm* — Panitch Schwarze Belisario & Nadel LLP

(57) ABSTRACT

A method for manufacturing an electrically conductive material includes steps of: (a) providing a carbon fiber; (b) providing a plastic fiber that differs from the carbon fiber; (c) producing a mixture in the form of a two-dimensional mat from the carbon fiber and the plastic fiber; (d) drying the mixture, optionally; (e) consolidating the mixture; (f) cutting the mixture to size, optionally; (g) carbonizing the mixture, wherein the carbonized plastic fibers form a carbon-based matrix possessing electrical conductivity that at least partially surrounds the carbon fibers. Electrically conductive materials obtained by the method have an increased electrical resistance. An emitter is specified that contains a transparent or translucent housing and an electrically conductive material as above. These now allow emitters of virtually any length to be operated at customary line voltages.

15 Claims, 2 Drawing Sheets

(51) Int. Cl.

| | |
|---|---|
| ***H01K 1/06*** | (2006.01) |
| ***H01K 3/02*** | (2006.01) |
| ***H05B 3/00*** | (2006.01) |
| ***H05B 3/14*** | (2006.01) |

(56) References Cited

U.S. PATENT DOCUMENTS

| | | | | |
|---|---|---|---|---|
| 4,540,624 | A | 9/1985 | Cannady, Jr. | |
| 5,354,607 | A | 10/1994 | Swift et al. | |
| 5,595,801 | A | 1/1997 | Fahy et al. | |
| 6,627,144 | B1 | 9/2003 | Suda et al. | |
| 6,845,217 | B2 | 1/2005 | Konishi | |
| 2004/0039096 | A1 | 2/2004 | Patel | |
| 2008/0006620 | A1* | 1/2008 | Lee et al. | 219/534 |
| 2010/0203257 | A1* | 8/2010 | Simor et al. | 427/491 |
| 2012/0018423 | A1 | 1/2012 | Linow | |
| 2012/0231252 | A1* | 9/2012 | Arakawa et al. | 428/219 |
| 2012/0235071 | A1* | 9/2012 | Moralez et al. | 252/62 |

FOREIGN PATENT DOCUMENTS

| | | | |
|---|---|---|---|
| DE | 102009014079 | B3 | 5/2010 |
| EP | 0004188 | A1 | 9/1979 |
| EP | 0700629 | B1 | 3/1999 |
| EP | 1496033 | A2 | 1/2005 |
| EP | 1739744 | A2 | 1/2007 |
| GB | 659992 | A | 10/1951 |

OTHER PUBLICATIONS

Pierson, "Handbook of Carbon, Graphite, Diamond and Fullerenes," Noyes Publications, Park Ridge, NJ (1993).

Int'l Search Report issued Jul. 5, 2013 in Int'l Application No. PCT/EP2012/002800.

Office Action issued Feb. 14, 2012 in DE Application No. 10 2011 109 578.4.

* cited by examiner

METHODS FOR PRODUCING AN ELECTRICALLY CONDUCTIVE MATERIAL, ELECTRICALLY CONDUCTIVE MATERIAL AND EMITTER CONTAINING ELECTRICALLY CONDUCTIVE MATERIAL

CROSS-REFERENCE TO RELATED APPLICATIONS

This application is a Section 371 of International Application No. PCT/EP2012/002800, filed Jul. 4, 2012, which was published in the German language on Feb. 14, 2013, under International Publication No. WO 2013/020620 A3 and the disclosure of which is incorporated herein by reference.

BACKGROUND OF THE INVENTION

The invention relates to a method for producing an electrically conductive material, an electrically conductive material, and an emitter containing an electrically conductive material.

The electrically conductive materials at issue are conceivable for use as electrically heatable elements for use in incandescent lamps or infrared emitters. Accordingly, the electrically conductive materials are suitable, in particular, for the targeted emission of beams in the visible, and in particular in the non-visible, range of wavelengths.

Electrically conductive materials of this type are often based on carbon or consist mainly of carbon. However, electrically conductive materials of the type at issue, used as a starting material, can comprise various materials alternative to or in addition to carbon that provide an electrical conductivity.

In ready-to-use, pre-assembled form, the electrically conductive materials at issue can also be referred to as incandescent filament, glow wire, glow coil, heating rod, and, in particular, as filament. Insofar as reference is made to filaments hereinafter, this shall always also comprise the electrically conductive material from which the filament is made.

The manufacture of electrically conductive materials, in particular of carbon-based materials, for use as an electrically heated element for use in incandescent lamps or infrared emitters has been known for a long time. The electrically conductive materials undergo a large number of manufacturing steps aimed at preparing the materials for long-lasting use at temperatures above 800° C.

In this context, it is generally difficult to manufacture all materials and/or filaments of a production lot to be within a defined tolerance range in terms of the electrical and mechanical properties on account of variations in the properties of the starting material, and to thus ensure that the radiation source has constant, consistent properties. In this context, the electrical properties generally are to be adjusted appropriately, such that the desired power (in the case of infrared radiation) or color temperature (in the case of incandescent lamps) at a given nominal voltage and given radiation source dimensions is attained. Moreover, the electrically conductive material should comprise sufficient mechanical strength and dimensional stability. Lastly, the effort and costs involved in the manufacture of the electrically conductive material should be at a reasonable level.

Depending on the desired purpose of application of the electrically conductive materials at issue herein, the requirements mentioned above generally will vary, and various technical solutions will be selected by a person skilled in the art in order to meet the requirements. An overview of the manufacture of electrically conductive materials is provided in John W. Howell, Henry Schroeder: *History of the Incandescent Lamp*, The Maqua Company, Schenectady, N.Y. (1927).

The electrically conductive materials can be manufactured, for example, by enveloping fibers, which are electrically conductive, with an appropriate enveloping material. The enveloping material can then provide a suitable matrix for the electrically conductive fibers, in particular after a heat treatment is carried out.

BRIEF SUMMARY OF THE INVENTION

It is obvious then that a person skilled in the art, aiming to attain certain properties in accordance with the profile of requirements mentioned above, aims to vary the electrical properties of the electrically conductive material in a targeted manner. A number of pertinent approaches are known from the prior art.

First, it is conceivable to vary the cross-sectional area of the electrically conductive material, in particular in pre-assembled form as a filament, with constant surface. In the case of electrically conductive materials designed in the shape of stretched tapes, this allows the electrical parameters to be adjusted over a wide range at approximately constant circumference and decreasing thickness. However, if extended emitters are to be operated at common voltages, the stretched tapes used as electrically conductive material prove to be too thin, too brittle and too fissure-prone.

From European Patent EP 0 700 629 B1 are known electrically conductive materials, in particular pre-assembled as filaments, which provide high power values at large emitter length combined with reasonable stability of the electrically conductive material, namely the filament. However, the electrical resistance of the filaments proposed therein is insufficient for operation of short or very long emitters at common electrical voltages in industrial applications. Moreover, it has been evident that varying the type of electrically conductive fiber within the electrically conductive material or of the type of resin used as a matrix forming agent provides no decisive change of the property if the filament made of electrically conductive material is also to be safe during processing.

Alternatively or in addition, it is known to dope starting materials of the electrically conductive material in order to attain certain electrical properties. Accordingly, an electrically conductive material can be manufactured, for example, from crystalline carbon, amorphous carbon, and further substances for adjusting the conductivity, for example nitrogen and/or boron. Materials of this type are described in U.S. Pat. No. 6,845,217. U.S. Pat. No. 6,627,144 proposes the use of organic resins, carbon powder, silicon carbide, and boron nitride.

However, electrically conductive material manufactured by these means is characterized in that filaments and/or heating rods obtained from them must not have less than a certain, considerable thickness. Moreover, the length of the filaments and/or heating rods is strongly limited. The cross-sectional area of the filaments resulting from these mechanical requirements leads to high conductivity at small surface area. Moreover, the low mechanical stability of the filaments renders industrial processing difficult, if not impossible.

In order to obtain good mechanical stability at lower conductivity, it is known to use electrically conductive materials that are based on fibers or fiber-containing material for lamps or emitters. In this context, low thickness values of the pre-assembled electrically conductive material (for example in the form of a filament or heating rod) at large surface area values can be attained such that the higher conductivity as compared to amorphous graphite can be compensated in the fibers. The filaments are usually manufactured by a carbonization and, optionally, a graphitization.

The carbonization usually proceeds at temperatures between 400° C. and 1,500° C. in an inert atmosphere, wherein hydrogen, oxygen, nitrogen, and, optionally, further elements that are present are eliminated from the material enveloping the electrically conductive fibers (enveloping material) resulting in an electrically conductive material having a high carbon content being produced. In the process, the enveloping material turns into a matrix that envelopes the electrically conductive fibers.

A graphitization proceeds at temperatures between 1,500° C. and 3,000° C. in an inert atmosphere at atmospheric pressure or in a vacuum, wherein any non-carbon components still present after carbonization evaporate from the electrically conductive fibers and matrix enveloping them, and wherein the micro-structure of the electrically conductive material is influenced by this. The matrix in this context shall be understood to be the carbonized material enveloping the electrically conductive fibers (i.e., the carbonized enveloping material).

For adjusting the electrical properties as desired, it is known in the context of the electrically conductive materials to dope the electrically conductive material. U.S. Pat. No. 487,046 describes the addition of substances from the gas phase, namely, in particular, of carbides, for incorporation into the electrically conductive material. This changes the electrical properties of the electrically conductive material. However, this method necessitates a laborious third heat treatment, in which each filament needs to be treated separately. Moreover, doping with carbides produces a very brittle electrically conductive material, which is not suitable for use in emitters used in appropriate or relevant dimensions for industrial infrared irradiation.

The electrical properties of the electrically conductive material can also be influenced as early as during a step of graphitization. The maximal temperature of graphitization and its duration influence to a certain degree the conductivity of the electrically conductive material thus generated. This effect is described in H. O. Pierson: *Handbook of Carbon, Graphite, Diamond and Fullerenes*, Noyes Publications, Park Ridge, N.J. (1993). However, since the high temperatures used for graphitization lower the resistance of the electrically conductive material, the effect is counter-productive in the manufacture of electrically conductive material for long emitters, since electrically conductive materials having high resistance at high filament temperatures are needed for long emitters.

The same applies to a deposition of additional carbon onto the surface of the electrically conductive material by pyrolysis, such as has been proposed in U.S. Pat. No. 248,437, for example. A method of this type can result in filling voids in the electrically conductive material and/or filament, but always leads to a reduction of the resistance, such that this also fails to achieve suitability of the electrically conductive material for use in long emitters or emitters operated at high nominal voltage.

British Patent Specification GB 659,992 proposes a method for reducing the cross-section of filaments made of a carbon-based electrically conductive material. An etching process in the gas phase is used in this context. The etching treatment is very laborious though and comprises not only the steps of carbonization and graphitization, but also multiple additional steps. Moreover, only electrically conductive materials and/or filaments which have not yet been provided with electrical contacts can be treated with the etching process. Filaments designed to take up strong electrical currents, however, are provided with electrical contacts as early as before the first heat process. Therefore, this method also cannot be used for manufacturing electrically conductive materials for very long emitters.

In summary, it can be stated that previously known electrically conductive materials and/or methods for manufacturing them basically do not allow the electrical properties of the material, in particular in the form of a filament, to be influenced by selecting electrically conductive components of the material, in particular of electrically conductive fibers. For adjusting certain electrical properties, it is therefore customary thus far to vary the length and/or cross-sectional area of the electrically conductive material and/or to change the electrically conductive material in one of the ways described above and/or after manufacture in terms of the composition and/or structure thereof.

Moreover, adjusting certain electrical properties according to the prior art is often associated with having to perform additional heat treatments on the electrically conductive material, which renders the production more complicated and more expensive. But even these methods generally do not allow the electrical properties to be adjustable over a sufficiently large range.

Likewise, the availability of electrically conductive materials and/or methods for the production thereof is unsatisfactory with a view to the use of electrically conductive materials in very long emitters at customary electrical voltages.

BRIEF SUMMARY OF THE INVENTION

The invention was based on the object to make a contribution to overcoming at least one of the disadvantages resulting from the prior art as described above that relate to the availability of electrically conductive materials.

Specifically, the invention was based on the object to provide an electrically conductive material and a method for the manufacture thereof, which allows for the operation of emitters, in particular of infrared emitters, of any length at customary line voltages.

The invention was also based on the object to provide an electrically conductive material and/or method for the manufacture thereof that is suitable for use in emitters, in particular in infrared emitters, and in particular in carbon infrared emitters, and which can be manufactured in great lengths, i.e., of more than 0.25 m, preferably of more than 0.5 m, more preferably of more than 1.0 m, and particularly preferably of more than 2.0 m.

Moreover, the invention was also based on the object to provide an electrically conductive material and/or method for the manufacture thereof, which comprises higher electrical resistance at otherwise identical design (length, diameter) than electrically conductive materials known thus far.

A contribution to meeting at least one of the objects specified above is made by a method for the manufacture of an electrically conductive material, wherein the method comprises the steps of:

a) providing a carbon fiber;
b) providing a plastic fiber that differs from the carbon fiber;
c) producing a mixture in the form of a two-dimensional mat from the carbon fiber and the plastic fiber;
d) drying the mixture, optionally;
e) consolidating the mixture;
f) cutting the mixture to size, optionally;

g) carbonizing the mixture, wherein the carbonized plastic fibers form a carbon-based matrix possessing electrical conductivity that at least partially surrounds the carbon fibers.

The mixture in the form of a two-dimensional mat preferably forms a so-called non-woven. Preferably, the mat is formed from carbon fibers and plastic fibers of short fiber length each.

The electrical resistance of the electrically conductive material that can be produced according to the invention is based mainly on the ratio of the number and/or respective mass of carbon fibers and plastic fibers, the length of the fibers, in particular of the carbon fibers, the orientation of the fibers with respect to each other, and the specific number of contact sites between different carbon fibers within the material.

What the invention attains in particularly artful manner is that a current flow oriented in any possible direction of current flow through the electrically conductive material is forced, at least over regions thereof, to proceed through the matrix that at least partially envelopes the electrically conductive fibers. Thus, the electrical properties of the electrically conductive material can be varied not only in a very targeted and accurate manner, but also across a surprisingly broad range in thus far unsurpassed manner.

Initially, in particular, the number, length, and orientation of the carbon fibers can be used to determine which fraction of the current flow is forced to proceed through the matrix material.

On the other hand, the electrically conductive matrix material can be selected appropriately overall to design the electrical properties of the electrically conductive material very accurately and reproducibly. For this purpose, a matrix material having a rather low or a high electrical conductivity can be selected. In this context, the matrix material is produced by carbonization of the plastic fibers used to produce the mixture.

Forcing the matrix material to be included in the flow of electrical current, as provided by the invention, is an effective means of overcoming a problem that is a well-known problem from the prior art, namely that the electrical properties of the electrically conductive material are determined largely by the electrically conductive fibers.

In this context, an electrically conductive material in the scope of the invention comprises, on the one hand, a base material that is suitable for further processing and/or shaping. However, the term, electrically conductive material, in the scope of the invention also comprises materials which have already undergone some level of pre-assembly, and specifically comprises a filament, an incandescent filament, a glow wire, a glow coil, a heating rod or the like. Moreover, the electrically conductive material can already comprise electrical contacts.

In particular, though without being limiting, the electrically conductive material according to the invention relates to materials or filaments, in particular two-dimensional filaments, for high intensity emitters, in particular lamps or infrared emitters, whose filament temperature clearly exceeds the oxidation limit of carbon on air, and which are therefore operated in a vacuum or in a protective atmosphere.

In the scope of the invention, a mat is a mixture of a multitude of single threads, namely fibers, which are deposited at random unlike in braiding or weaving. A mat of this type is produced, in particular, when various threads and/or fibers of short fiber length each are mixed and laid down. For delimitation, woven materials are generally produced by guiding one or more wefts through a number of warp threads. Usually, warp threads and wefts are situated at an angle of approximately 90° with respect to each other. In the case of a braided material, at least three threads are placed around each other. Usually, these at least three threads are situated with respect to each other at an angle different from approx. 90°. Unlike in weaving and braiding, however, mats do not involve the single thread being guided.

In the mixture in the form of a two-dimensional mat, the plastic fibers can also be referred to as surrounding material that surrounds the carbon fibers. The surrounding material can coat, bond, hold, or impregnate the carbon fibers.

The mixture in the form of a two-dimensional mat made of the carbon fiber and the plastic fiber, in particular in consolidated form, can also be referred to as a composite of carbon fibers and plastic fibers.

If it appears expedient, further additives can be present in the mixture of carbon fibers and plastic fibers. A refinement of this type of composite of carbon fibers and plastic fibers is therefore no departure from the general scope of the invention.

The carbon fibers shall also be referred to as electrically conductive fibers hereinafter. These terms are used synonymously.

Consolidation of the mixture in the scope of the application is defined to be a mechanical solidification and/or compacting of the mixture of carbon fiber and plastic fiber. In this context, the consolidation can involve an exposure to heat. A consolidation can be implemented, for example, by rolling or heating the mixture or by both.

Carbonization of the mixture for conversion of the plastic fibers into a carbon-based material possessing electrical conductivity comprises the high temperature treatment of the consolidated mixture in a temperature range from 600° C. to 1,500° C. Particularly preferred in this context is a temperature range from 800° C. to 1,200° C. During carbonization, a carbon-based matrix possessing electrical conductivity is generated from the plastic fibers and/or from the surrounding material. The matrix surrounds the carbon fibers, at least in part, which are essentially not converted during the carbonization step. Optionally, a graphitization may follow after a carbonization. Both process steps have already been illustrated above.

The term, possible direction of current or current flow through the electrically conductive material, basically describes any direction, in which current can be conducted through the electrically conductive material according to the invention. However, a preferred direction of current flow is along a direction of longitudinal extension of the electrically conductive material. The direction of longitudinal extension can coincide, in particular, with the longitudinal axis of an emitter housing, in which the electrically conductive material can be introduced, in particular as filament. However, it is always possible in this context that the electrically conductive material is designed to be coil-shaped or meandering such that a direction of longitudinal extension of the electrically conductive material in this respect may deviate from a longitudinal axis of an enveloping housing. In particular, a possible direction of current coincides with the direction of longitudinal extension of the filament.

According to a first preferred refinement of the method according to the invention, the mass fraction of carbon fibers with respect to the mixture is 1% by mass (mass %) to 70 mass %. Preferably, the mass fraction is 30 mass % to 60 mass %, particularly preferably 45 mass % to 55 mass %.

According to another advantageous embodiment, the mixture has a fiber weight per unit area of 75 g/m$^2$ to 500 g/m$^2$. A fiber weight per unit area of 120 g/m$^2$ to 260 g/m$^2$ is particularly preferred in this context. These specifications of preferred fiber weights per unit area refer to a mixture that has not yet been carbonized, but has already been consolidated.

A refinement of the method, in which the length of the carbon fibers and plastic fibers in the mixture differs by maximally 50% relative to the length of the carbon fibers, proves to be expedient. Preferably, the length of the carbon fibers and plastic fibers differs by maximally 10%, particularly preferably by maximally 5%, each relative to the length of the carbon fibers. The respective fiber length shall be understood to mean the mean fiber length of the corresponding fiber species, which can be determined using known statistical methods. The length of carbon fibers and plastic fibers being as close to equal as possible simplifies, first, the production of a homogeneous mixture. Moreover, the electrical properties of the electrically conductive material produced later on are better adjustable and thus more accurately predictable if the prerequisite is met.

In an expedient refinement of the scope of the invention, the carbon fiber or the plastic fiber or both in the mixture have a fiber length of 3 mm to 30 mm. A fiber length in a range from 10 mm to 25 mm is preferred, and in a range from 15 mm to 20 mm is particularly preferred in this context. In the scope of the refinement, alternatively or in addition to the preceding embodiment, better miscibility of the components and accurate adjustability of the electrical properties of the electrically conductive material produced later on is obtained.

The carbon fiber is preferably obtained from poylacrylonitrile (PAN), tar, viscose, or a mixture of at least two these. The carbon fiber preferably comprises a PAN-based fiber and/or a fiber having no surface coating. In case the surface is coated, a preferred coating leaves a carbon residue behind upon another carbonization, but at least does not damage the carbon fiber.

Another advantageous refinement of the method is characterized in that the plastic fiber contains a thermoplastic material. Preferably, the fraction of thermoplastic material relative to the plastic fiber is at least 40 mass %, more preferably at least 80 mass %, and particularly preferably at least 95 mass %, each relative to the total mass of the plastic fiber. A plastic fiber that comprises thermoplastic fractions or consists fully of thermoplastic material proves to be particularly well-suited for mixing with a carbon fiber and for producing a two-dimensional mat. Moreover, high carbon fractions are attained from thermoplastic materials after the carbonization. The thermal consolidation of mixtures containing thermoplastic materials is also made easier.

The thermoplastic material can contain polyethersulfone (PES), polyetheretherketone (PEEK), polyetherimide (PEI), polyethyleneterephthalate (PET), polyphthalamide (PPA), polyphenylenesulfide (PPS), polyimide (PI), or a mixture of at least two of these. In this context, PEEK and/or PET, which provide a high carbon fraction after the carbonization, are particularly preferred.

According to another refinement, another plastic fiber made of duroplastic material is used in addition to the plastic fiber made of thermoplastic material. The duroplastic material can preferably contain a vinylester resin, a phenol resin, an epoxide resin, or a mixture of at least two of these.

According to a preferred refinement of the method according to the invention, the electrically conductive material is produced to have a carbon content of at least 95 mass %. A preferred carbon content is, in particular, more than 96 mass %, particularly preferably more than 97 mass %. A preferred upper limit of the carbon content is 99.6 mass % though.

According to a particularly preferred embodiment of the method according to the invention, the specific electrical conductivity of the matrix is lower than that of the electrically conductive fibers. A current flow that is forced through at least a partial region of the matrix, as provided by the invention, can thus lead to an overall increase in the electrical resistance of the electrically conductive material altogether.

Preferably, the specific electrical conductivity of the matrix is lower by a factor of at least 5, preferably at least 10, as compared to the electrically conductive fibers.

A preferred refinement of the method provides for the use of carbon fibers, in particular of PAN-based carbon fibers, which have a resistivity at room temperature of $1.0\times10^{-3}$ to $1.7\times10^{-3}$ Ω cm, particularly preferably of $1.6\times10^{-3}$ Ω cm. In addition or separately, the use of plastic fibers having a resistivity at room temperature of more than $10^{7}$ Ω cm, particularly preferably of more than $10^{16}$ Ω cm, is preferred. In a subsequent step of the method according to the invention, the matrix possessing electrical conductivity is produced from the plastic fibers.

As mentioned above, the production of a matrix made of plastic fibers having thermo-plastic and/or duroplastic fractions is preferred. Further filling agents, such as inorganic particles, preferably oxides, sulfates, aluminates, or mixtures thereof, can be added to the thermoplastic and/or duroplastic material within the enveloping material.

Generally, a refinement of the method according to the invention is preferred, in which the plastic fiber comprises a thermoplastic material as enveloping material and as the basis of the matrix. However, alternatively or in addition, the enveloping material can just as well comprise a duroplastic material.

In another preferred embodiment of the method, the mat is made deformable again by heating before the carbonization and is deformed, in particular by drawing and/or stretching in the plane of the mat and/or by deformation perpendicular to the plane of the mat and/or by twisting the mat. A targeted influence on the electrical and/or mechanical properties of the electrically conductive material produced later can thus be exerted.

Alternatively or in addition, the mat can be reinforced by at least one layer of carbon fibers before the carbonization, in particular before the cutting-to-size or consolidation or drying.

Alternatively or in addition, the material can be reinforced by at least one carbon fiber roving before the carbonization, in particular before the cutting-to-size or consolidation or drying.

Carbon fiber rovings are bundles of carbon fibers, which preferably have great length. Moreover, rovings preferably are non-twisted fiber bundles. Commercial rovings are commercially available containing 12,000; 3,000; and, more rarely, 1,000 fibers per roving. The diameter of a single carbon fiber in this context generally is approx. 5 μm to approx. 8 μm.

That there exists only a very limited number of rovings containing any other number of fibers illustrates again the limitation of the technically feasible variations of different electrically conductive materials and/or filaments according to the prior art, since broadly varying resistance values cannot be covered by the few commercially available rovings at this time.

According to a further refinement of the method, the mat is thermally consolidated with at least one layer or at least one roving of carbon fibers before the reinforcement, and is thermally consolidated again after reinforcement and carbonization.

Referring to a further desirable increase of the resistance of the electrically conductive material, an embodiment of the method is proposed, in which the carbon is being removed from the electrically conductive material. The removal process preferably proceeds after the manufacture of the electrically conductive material is completed. It is particularly preferable in this context to treat the electrically conductive material with a reactive fluid, in particular hydrogen and/or water vapor. In addition, a protective gas, preferably argon, can be used during the treatment.

A contribution to meeting the objects specified above is also made by an electrically conductive material that can be obtained according to a method according to the invention. The electrically conductive material can, in particular, serve for generating infrared radiation and is suitable, in particular, for providing filaments, glow filaments, glow wires, glow coils, or heating rods as radiation sources, in particular for infrared emitters. In this context, reference is made to the information provided with respect to the method according to the invention.

A contribution to meeting the objects specified above is also made by an electrically conductive material comprising a compound that includes:

a) a first carbon fiber and a further carbon fiber; and b) a matrix that partly surrounds the first carbon fiber and the further carbon fiber each, wherein the electrical conductivity of the matrix is lower than that of the carbon fibers; wherein, with respect to a sectional plane through the composite, of the total number of carbon fibers extending through the sectional plane, more than 20% of the carbon fibers extending through the sectional plane do not contact any other carbon fiber extending through the same sectional plane.

A particularly preferred refinement has more than 40% of the carbon fibers extending through the sectional plane not contact any other carbon fiber extending through the same sectional plane.

In this context, the specification of the fraction of carbon fibers contacting no other carbon fiber extending through the same sectional plane is a measure of the resistivity of the electrically conductive material. The fewer carbon fibers that contact other carbon fibers in the manner described above, the higher is the resistivity of the electrically conductive material. This applies subject to the prerequisite that the matrix has a lower resistivity than the carbon fibers, which is preferred in the scope of the invention. The lower the fraction of carbon fibers contacting each other, the higher is the fraction of the current flow which is forced to flow through the matrix.

Varying the fraction of carbon fibers in contact allows the electrical properties of the electrically conductive material to be adjusted over a wide range and with substantial accuracy. The fraction of carbon fibers in contact can be determined by statistical methods. This can be based on photographs of microscopic sections of the electrically conductive material.

Preferably, an above-mentioned sectional plane through the electrically conductive material is defined such that the sectional plane is oriented to be orthogonal to a possible direction of current flow through the material. The term, possible direction of current flow through the electrically conductive material, has been defined above. It is expedient, in particular, to define a sectional plane that is oriented to be orthogonal to a direction of longitudinal extension of the electrically conductive material, wherein, in particular, the electrically conductive material is provided to be elongated, preferably as a filament.

Another advantageous embodiment of the electrically conductive material according to the invention has at least one of the following properties:

i. the matrix has a defined specific electrical conductivity;

ii. the matrix defines an orientation of the carbon fibers;

iii. the matrix defines a specific number of contact sites between carbon fibers;

iv. the carbon fibers are distributed and/or oriented in the matrix in appropriate manner, such that a current flow through the material is forced to proceed at least through a portion of the matrix.

A particularly preferred electrically conductive material has more than one of the properties specified above, wherein a material having all of the properties is even more particularly preferred.

The electrically conductive material according to the invention can, optionally, also be produced directly as a filament which has already been provided with electrical end-contacts. If the plastic fiber comprises a thermoplastic material, the following sub-method is proposed: a) cutting the mat to size; b) applying the electrical end-contacts; c) carbonization; d) graphitization. Subsequently, the filament can be processed to produce an emitter.

If the plastic fiber comprises a duroplastic material, the following sub-method is preferred: a) cutting the mat to size; b) applying the electrical end-contacts; c) oxidation, optionally; d) carbonization; e) graphitization. Subsequently, the filament can be processed to produce an emitter.

A contribution to meeting the objects specified above is also made by an emitter which contains:

a) a transparent or translucent housing; and b) an electrically conductive material according to the invention arranged in the housing.

The electrically conductive material arranged in the emitter can, in particular, be preassembled as a filament and/or take the shape of a glow wire, a filament, a glow coil, a heating rod, or a heating plate.

An emitter, in which the electrically conductive material has appropriate flexibility, such that it can be bent into a circle and over its entire length about a radius of 1.0 m, preferably less than 1.0 m, particularly preferably 0.25 m, without fracturing the carbon fibers and/or the matrix and/or without separating the carbon fibers and the matrix, is preferred. In any case, the electrically conductive material should have a tendency to return to the extended shape imparted on it after being bent.

The emitter can comprise an electrically conductive material having an electrical conductivity, measured as electrical operating voltage per length of the electrically conductive material, in particular of the filament, in a range of more than 150 V/m, preferably more than 300 V/m.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

The appended figures and the exemplary embodiments shown in them shall first be illustrated in general manner in the following. A number of additional exemplary embodiments are illustrated concisely in the following.

Figure 1:
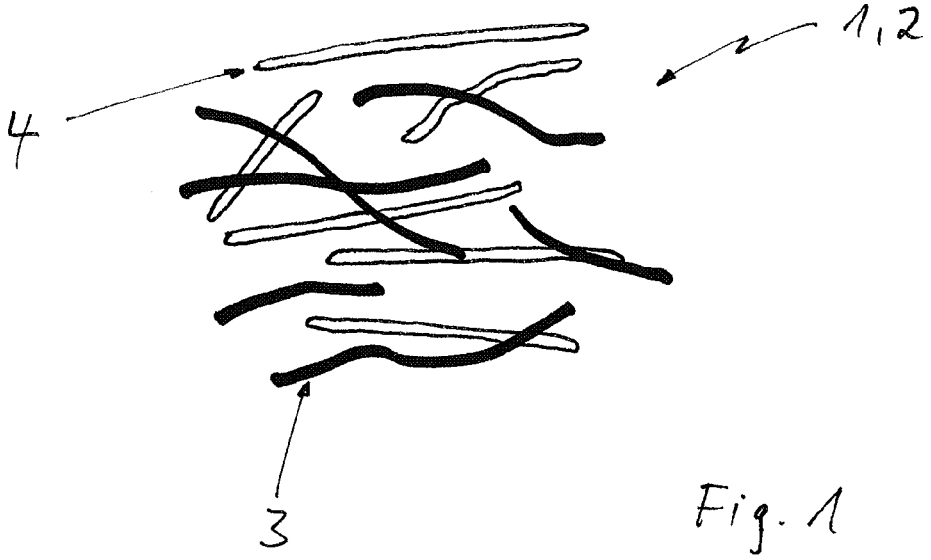
FIG. 1 is a schematic depiction of a highly magnified sectional view of a mixture in the form of a two-dimensional mat according to an embodiment of the invention.

FIG. 1 shows a schematic depiction of a highly magnified sectional view of a mixture 1 in the form of a two-dimensional mat 2, wherein the mixture 1, in a preferred embodiment of the method according to the invention, embodies a precursor stage of the electrically conductive material obtainable according to the invention. In this context, the two-dimensional mat 2 is a mixture 1 of essentially randomly laid-down carbon fibers 3 (shown filled-in) and plastic fibers 4 (shown as outlines), which each have a short fiber length in the range from approx. 3 mm to approx. 30 mm. Moreover, according to the present example, the carbon fibers 3 and the plastic fibers 4 in the mixture 1 differ in length by maximally 50% relative to the length of the carbon fibers 3.

Figure 2:
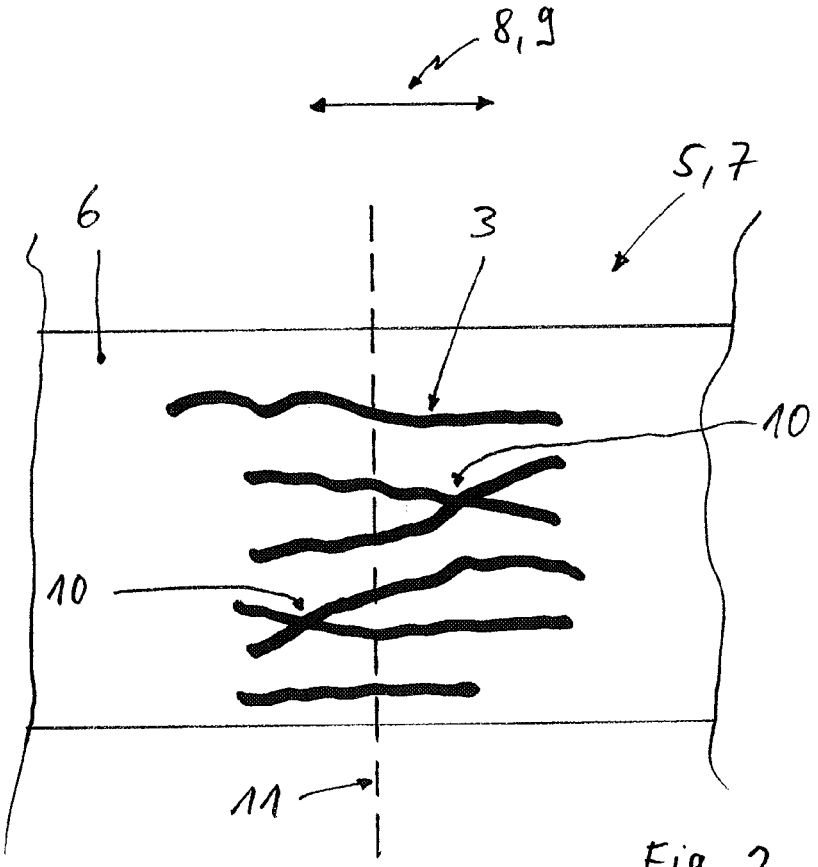
FIG. 2 is a schematic, strongly magnified sectional view of a preferred embodiment of the electrically conductive material according to the invention.

FIG. 2 also shows a schematic, strongly magnified sectional view of a preferred embodiment of the electrically conductive material 5 according to the invention, that can be obtained by a preferred embodiment of the method according to the invention. The carbon fibers 3 are again shown filled-in. The plastic fibers have been converted by carbonization of the mixture into a carbon-based matrix 6 possessing electrical conductivity that surrounds the carbon fibers 3. For this reason, the plastic fibers are not shown any more in FIG. 2.

Figure 3:
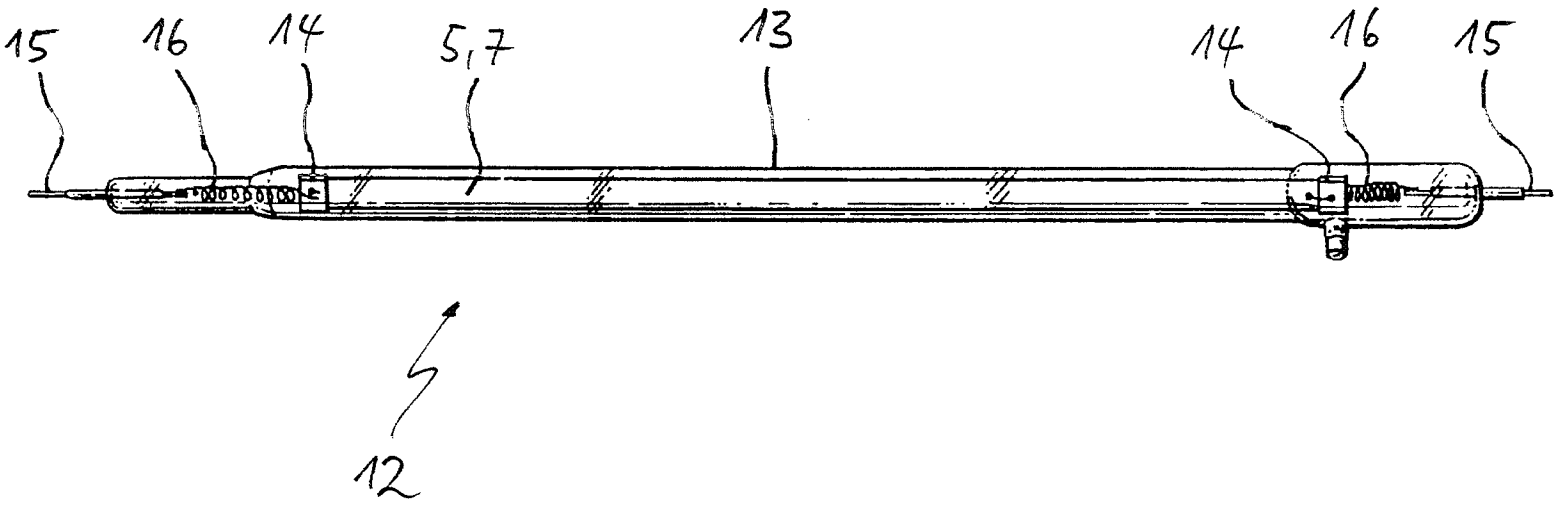
FIG. 3 is a side view of a preferred exemplary embodiment of an emitter according to the invention, shown here as an infrared emitter.

FIG. 3 shows a side view of a preferred exemplary embodiment of an emitter 12 according to the invention, which is provided as an infrared emitter in the present case. The emitter 12 comprises an electrically conductive material 5, which is provided in the form of an elongated filament 7. In this context, the filament 7 is manufactured from an electrically conductive material 5 according to the invention. The filament 7 is enveloped by a transparent housing 13, which can also be referred to as a shell tube. The housing 13 contains a protective gas, namely argon. Alternatively, the filament 7 can be operated in the housing 13 in a vacuum.

The plastic fibers 4 contain a thermoplastic material in the present example. PEEK and/or PET are particularly preferred in this context.

According to the further procedure of the preferred embodiment of the method according to the invention considered presently, a possibly necessary step of drying precedes a consolidation of the mixture 1, namely of the two-dimensional mat 2. Afterwards, the mixture 1 can preferably have a fiber weight per unit area of 75 g/m$^2$ to 500 g/m$^2$.

After (possibly) cutting the mat 2 to size there follows the carbonization of the mixture 1, wherein the carbonized plastic fibers 4 are converted into a carbon-based matrix possessing electrical conductivity that surrounds the carbon fibers 3 at least in part. The matrix is formed only in the electrically conductive material that can be obtained according to the invention, and is therefore not yet shown in FIG. 1.

The electrically conductive material 5 according to the invention is provided as a filament 7 in the present example of which a middle section is shown. The electrically conductive material 5, namely the filament 7, extends in a direction of longitudinal extension 8, which coincides with the direction of current flow 9 during the later operation of the filament 7.

It is evident from the schematic view shown according to FIG. 2 that a current flow through the electrically conductive material 5, in particular in the direction of longitudinal extension 8, is always being forced to proceed at least through a partial region of the matrix 6.

The electrical properties of the electrically conductive material 5 are determined, inter alia, by the length of the carbon fibers 3 and/or of the plastic fibers 4 (cf. FIG. 1), the orientation of the carbon fibers 3, the mass ratio of the fibers 3, 4, the defined specific electrical conductivity of carbon fibers 3 and matrix 6, and the specific number of contact sites 10 of various carbon fibers 3 within the matrix 6.

Accordingly, FIG. 2 also illustrates a view for quantitative determination of the number of contact sites 10 of carbon fibers 3 within the matrix 6. First, an arbitrary sectional plane 11 through the electrically conductive material 5 is defined. The sectional plane 11 is expediently oriented such as to be orthogonal to a possible direction of current flow 9. The direction of current flow 9 in the present filament 7 is given by the direction of longitudinal extension 8 of the filament 7, such that the sectional plane 11 is oriented orthogonal to the direction of longitudinal extension 8 of the filament 7.

Now, all carbon fibers 3 extending through the sectional plane 11 are observed. Then, the fraction of the total number of carbon fibers 3, which extend through the sectional plane 11 and do not contact any other carbon fiber 3 extending through the same sectional plane 11 is determined. The fewer contact sites 10 of various carbon fibers 3 exist within the matrix 6, the higher is the fraction of the current flow forced to proceed through at least a partial region of the matrix 6. Accordingly, this is associated with an increase in the electrical resistance of the electrically conductive material 5. In the present schematic example, two of a total of 6 carbon fibers 3 extending through the sectional plane 11 contact no other carbon fiber 3 that extends through the same sectional plane 11. The fraction of non-contacting carbon fibers 3 therefore is approx. 33%.

The filament 7 is connected to electrical leads 15 by contacting elements 14. A coil-shaped compensation element 16 is arranged between each of the contacting elements 14 and the electrical leads 15, in order to be able to compensate the differences in thermal expansion of the housing 13 and filament 7. The electrical leads 15 exit from the housing 13 in a vacuum-tight manner. For this purpose, crimping connections or any other expedient technique for vacuum-tight pass-through can be applied.

Measuring Methods

Resistivity

The stated values of the resistivity refer to a determination by a measuring method in accordance with DIN IEC 60093 (1983): Test Methods for Electro-Insulating Materials; Specific Through Resistance and Specific Surface Resistance of Solid, Electrically Insulating Materials.

Electrical Conductivity, Specific Electrical Conductivity, and Electrical Resistance The conductivity of the electrically conductive material can be measured in cold condition and/or before integration into an emitter or the like using a resistance measuring device or a conductivity measuring device, wherein the geometrical dimensions of the electrically conductive material, in particular a filament, determined by a measuring tape or slide ruler (length, width, thickness) and the electrical resistance as measured can be used to also calculate the resistivity (see above).

The electrical resistance of the electrically conductive material, integrated into an emitter and/or during its intended use, can be calculated from a measurement of the voltage drop across the emitter and measurement of the current flowing through the emitter by applying Ohm's law. Moreover, if the geometrical dimensions of the electrically conductive material have been determined prior to integrating the electrically conductive material into the emitter, the temperature-dependent value of the resistivity of the electrically conductive material can also be calculated by this means. This method for calculation of the resistivity is preferred, since the measurement it includes cannot be falsified by the contact resistance.

Specific Conductivity of the Fibers and Matrix Material

The specific electrical conductivity can be determined by performing separate measurements on the electrically conductive fibers (namely the carbon fibers) before using them in order to produce the electrically conductive material, and on the matrix material (namely the carbonized plastic fibers). Matrix material without electrically conductive fibers can be obtained, e.g. by subjecting 50 g of the plastic fibers (e.g. a thermoplastic polymer) to heat treatment at approx. 980° C. for approx. 60 min in the absence of air.

Distribution of Fiber Lengths

The fiber lengths can be determined by geometrical means before processing them into a mat. The average fiber length and the fiber length distribution can be derived from the values. The mean fiber lengths change in predictable manner due to the filaments being cut-to-size.

Flexibility of the Electrically Conductive Material

The flexibility can be determined by bending the electrically conductive material along its entire length into a circle having a radius of, preferably, approx. 0.25 m-1.0 m. The absence of fractures of the carbon fibers and/or matrix and/or the absence of separation of the carbon fibers and matrix is a measure of the flexibility of the electrically conductive material. For example, electrically conductive materials are considered to be particularly flexible if they can be bent about a circular profile having a radius of 0.25 m. In order to pass the flexibility test at a constant radius, the electrically conductive material should always have a tendency to return to the extended shape previously imparted on it.

Non-limiting exemplary embodiments of the invention, in particular of the method according to the invention and thus of the electrically conductive material according to the invention as well, are illustrated in more detail in the following.

EXAMPLES

Exemplary Embodiment 1

In order to produce the electrically conductive material, in the form of a filament in the present case, a so-called non-woven material is produced first from which then the filaments are then cut at the needed dimensions.

The non-woven material consists of carbon fibers cut to 3-12 mm in length and fibers made of a thermoplastic material, PEEK in the present case, cut to approximately the same size. PET can be used just as well, but it may then be necessary to select a different ratio of carbon fibers to thermoplastic fibers.

The carbon fibers and the plastic fibers, in the form of thermoplastic fibers in the present case, are then distributed simultaneously and homogeneously onto a surface. The homogeneous distribution is attained, e.g., using a shaker distributing the fibers onto an unreeling tape. The shaker preferably has a track width of 300 mm. In this context, the carbon fibers and the thermoplastic fibers are preferably (a) distributed over the surface at a homogeneous density, such that the distribution of thermoplastic fibers and carbon fibers is homogeneous even on a small scale, and (b) distributed over the surface, such as to mix with each other and cover each other. Distinct layers of carbon fibers and plastic fibers arranged one above the other and not homogeneously mixed with each other should not be formed on the surface. In this context, a homogeneous distribution even on a small scale is to mean that a homogeneous distribution preferably on a surface of 10 mm×10 mm, more preferably 4 mm×4 mm, is to be evident.

The later electrical properties of the electrically conductive material are defined in this processing step. The electrical conductivity can be adjusted in this context, inter alia, by the weight per unit area, i.e., the mass per unit area of consolidated material, the number of contact sites of carbon fibers to each other per unit area, and via the volume fraction of plastic fibers in the consolidated mixture. The fewer mutual contact sites of carbon fibers are present and the higher the fraction of plastic fibers, the higher will be the resistivity of the electrically conductive material.

The consolidated mixture is then dried, if required, and thermally consolidated afterwards. During consolidation, the poured-out material is heated first, which is preferably effected by infrared radiation. This renders the fraction of the mixture accounted for by plastic fibers, consisting of thermoplastic material in the present case, deformable, and this is pressed together between hot rollers to which pressure is being applied right after the heating process.

The consolidated starting material, namely the consolidated mixture, is then used to cut the requisite filaments of the desired width and length.

Subsequently, electrical contacts are attached to the filaments, the filaments are carbonized, and then graphitized according to need.

Subsequently, the filaments can be provided with electrical leads, can be introduced into quartz tubes, and the quartz tubes can be closed in appropriate manner, such that a protective gas atmosphere, preferably of argon, can be present inside the emitter tube. Finally, ceramic elements and electrical leads are attached to the outside according to need. In this regard, reference is made in exemplary manner to the depiction and description according to FIG. 3.

Exemplary Embodiment 2

In order to produce the electrically conductive material, in the form of a filament in the present case, a so-called non-woven material is produced first, from which then the filaments are then cut at the needed dimensions.

The non-woven material consists of carbon fibers cut to 3-12 mm in length and fibers made of a thermoplastic material, PEEK in the present case, cut to approximately the same size. PET can be used just as well, but it may then be necessary to select a different ratio of carbon fibers to thermoplastic fibers.

The carbon fibers and the plastic fibers, in the form of thermoplastic fibers in the present case, are then distributed simultaneously and homogeneously onto a surface. The homogeneous distribution is attained, e.g., using a shaker distributing the fibers onto an unreeling tape. The shaker preferably has a track width of 300 mm. In this context, the carbon fibers and the thermoplastic fibers are preferably (a) distributed over the surface at a homogeneous density, such that the distribution of thermoplastic fibers and carbon fibers is homogeneous even on a small scale, and (b) distributed over the surface, such as to mix with each other and cover each other. Distinct layers of carbon fibers and plastic fibers arranged one above the other and not homogeneously mixed with each other should not be formed on the surface. In this context, a homogeneous distribution even on a small scale is to mean that a homogeneous distribution preferably on a surface of 10 mm×10 mm, more preferably 4 mm×4 mm, is to be evident.

The later electrical properties of the electrically conductive material are defined in this processing step. The electrical conductivity can be adjusted in this context, inter alia, by the weight per unit area, i.e., the mass per unit area of consolidated material, the number of contact sites of carbon fibers to each other per unit area, and via the volume fraction of plastic fibers in the consolidated mixture. The fewer mutual contact sites of carbon fibers are present and the higher the fraction of plastic fibers, the higher will be the resistivity of the electrically conductive material.

The consolidated mixture is then dried, if required, and thermally consolidated afterwards. During consolidation, the poured out material is heated first, which is preferably effected by infrared radiation. This renders the fraction of the mixture accounted for by plastic fibers, consisting of thermoplastic material in the present case, deformable, and this is pressed together between hot rollers to which pressure is being applied right after the heating process.

The consolidated starting material, namely the consolidated mixture, is then used to cut the requisite filaments of the desired width and length.

In a modification of the exemplary embodiment 1, these filaments are plasticized again and reshaped by heat. This renders it feasible to draw the tape (filament) locally and to deform in planar extension as well. Thus, desired electrical properties of the later electrically conductive material can be designed in a targeted manner.

Exemplary Embodiment 2.1

In a first sub-embodiment of exemplary embodiment 2, the tape (filament) is subsequently stretched lengthwise, in order to facilitate a preferred orientation of the fibers in the longitudinal direction of the tape. The resistance of the tape itself is basically not changed in this context, since the resistance is basically defined by the length of the conduction path and the number of contact sites amongst the carbon fibers. However, the specific electrical power output per filament length (typically specified in units of W/cm) is varied thus.

Exemplary Embodiment 2.2

In a second sub-embodiment of exemplary embodiment 2, the tape (filament) is subsequently stretched width-wise in order to facilitate a preferred orientation of the fibers in the transverse direction of the tape. The resistance of the tape is basically not changed in this context, but the specific electrical power output (typically specified in units of W/cm) is varied thus.

It must be made sure in both cases (exemplary embodiments 2.1 and 2.2) that there is no formation of fissures or delamination in the filament. For this reason, the methods should be limited to stretching factors of up to 2 at most.

Exemplary Embodiment 2.3

A twisted filament is produced according to the present exemplary embodiment. For this purpose, the stretched and heated filament is converted into an internally twisted form by suitable rollers and guides. The screw shape can be maintained without tension forming in the material after it is cooled down.

Then, electrical contacts are attached to the filaments and the filaments are carbonized. In this context, twisted filament tapes are stored in the furnace stabilized in shape by brackets such as not to loose the twisted shape of the tapes. After carbonization, twisted tapes without internal tension are present which can then be graphitized according to need.

The filaments according to exemplary embodiments 2.1 and 2.2 are also subjected to carbonization according to the steps described above and according to the detailed description provided above.

Subsequently, the filaments can be provided with electrical leads, can be introduced into quartz tubes, and the quartz tubes can be closed in appropriate manner, such that a protective gas atmosphere, preferably of argon, can be present inside the emitter tube. Finally, ceramic elements and electrical leads are attached to the outside according to need. In this regard, reference is made in exemplary manner to the depiction and description according to FIG. 3.

Exemplary Embodiment 3

According to the present exemplary embodiment, a non-woven material is produced, which is additionally reinforced with through-going carbon fibers. Then, filaments of the requisite dimensions are cut from the reinforced material thus produced.

The non-woven material consists of carbon fibers cut to 3-12 mm in length and fibers made of a thermoplastic material, PEEK in the present case, cut to approximately the same size. PET can be used just as well, but it may then be necessary to select a different ratio of carbon fibers to thermoplastic fibers.

The carbon fibers and the plastic fibers, in the form of thermoplastic fibers in the present case, are then distributed simultaneously and homogeneously onto a surface. The homogeneous distribution is attained, e.g., using a shaker distributing the fibers onto an unreeling tape. The shaker preferably has a track width of 300 mm. In this context, the carbon fibers and the thermoplastic fibers are preferably(a) distributed over the surface at a homogeneous density, such that the distribution of thermoplastic fibers and carbon fibers is homogeneous even on a small scale, and (b) distributed over the surface, such as to mix with each other and cover each other. Distinct layers of carbon fibers and plastic fibers arranged one above the other and not homogeneously mixed with each other should not be formed on the surface. In this context, a homogeneous distribution even on a small scale is to mean that a homogeneous distribution preferably on a surface of 10 mm×10 mm, more preferably 4 mm×4 mm, is to be evident.

The later electrical properties of the electrically conductive material are defined in this processing step. The electrical conductivity can be adjusted in this context, inter alia, by the weight per unit area, i.e., the mass per unit area of consolidated material, the number of contact sites of carbon fibers to each other per unit area, and via the volume fraction of plastic fibers in the consolidated mixture. The fewer mutual contact sites of carbon fibers are present and the higher the fraction of plastic fibers, the higher will be the resistivity of the electrically conductive material.

The non-woven material is then reinforced by one or more layers of carbon fibers by application of one or more layers of carbon fibers to one or both sides of the non-woven material. A layer of carbon fibers is produced by guiding one or more carbon fiber rovings through a broad, fine comb such that the fibers are distributed largely parallel to each other onto a larger surface. The layer of carbon fibers thus obtained has, seen over its width, many fibers arranged next to each other, wherein its thickness is a result of single or few carbon fibers being arranged over each other.

The mixture is then dried, if required, and thermally consolidated afterwards. During consolidation, the poured-out material and the carbon fibers possibly placed underneath and above it are heated first (preferably by infrared radiation) rendering the plastic fraction, consisting of thermoplastic material in the present case, deformable, and this is pressed together between hot rollers to which pressure is being applied right after the heating process.

The starting material is then used to cut the filaments to the desired width and length.

The further processing is analogous to exemplary embodiment 1, but special diligence should be devoted to a parallel orientation of the reinforcing carbon fibers with respect to the direction of pull. Moreover, the cutting in longitudinal direction should proceed exactly parallel to the reinforcing carbon fiber rovings.

Exemplary Embodiment 4

In order to produce the electrically conductive material, in the form of a filament in the present case, a so-called non-woven material is produced first which is then reinforced with through-going carbon fibers. Then, filaments of the requisite dimensions are cut from the reinforced material thus produced.

The non-woven material consists of carbon fibers cut to 3-12 mm in length and fibers made of a thermoplastic material, PEEK in the present case, cut to approximately the same size. PET can be used just as well, but it may then be necessary to select a different ratio of carbon fibers to thermoplastic fibers.

The carbon fibers and the plastic fibers, in the form of thermoplastic fibers in the present case, are then distributed simultaneously and homogeneously onto a surface. The homogeneous distribution is attained, e.g., using a shaker distributing the fibers onto an unreeling tape. The shaker preferably has a track width of 300 mm. In this context, the carbon fibers and the thermoplastic fibers are preferably (a) distributed over the surface at a homogeneous density, such that the distribution of thermoplastic fibers and carbon fibers is homogeneous even on a small scale, and (b) distributed over the surface, such as to mix with each other and cover each other. Distinct layers of carbon fibers and plastic fibers arranged one above the other and not homogeneously mixed with each other should not be formed on the surface. In this context, a homogeneous distribution even on a small scale is to mean that a homogeneous distribution preferably on a surface of 10 mm×10 mm, more preferably 4 mm×4 mm, is to be evident.

The later electrical properties of the electrically conductive material are defined in this processing step. The electrical conductivity can be adjusted in this context, inter alia, by the weight per unit area, i.e., the mass per unit area of consolidated material, the number of contact sites of carbon fibers to each other per unit area, and via the volume fraction of plastic fibers in the consolidated mixture. The fewer mutual contact sites of carbon fibers are present and the higher the fraction of plastic fibers, the higher will be the resistivity of the electrically conductive material.

The non-woven material is then reinforced by one or more layers of carbon fibers by application of one or more layers of carbon fibers to one or both sides of the non-woven material. A layer of carbon fibers is produced by guiding one or more carbon fiber rovings through a broad, fine comb such that the fibers are distributed largely parallel to each other onto a larger surface. The layer of carbon fibers thus obtained has, seen over its width, many fibers arranged next to each other, wherein its thickness is a result of single or few carbon fibers being arranged over each other.

In this context, the carbon fibers can be used either evenly distributed as thin layers or placed-in in targeted manner as rovings of low fiber number at specific positions.

According to a first preferred embodiment, it has proven expedient to spread a roving with 12,000 fibers per roving (12 k roving) over a width of 60 mm. This attains an ideal combination of increased resistance to pull of the material and a still slight increase of the conductivity of the filament.

In a second embodiment, rovings having 1,000 fibers per roving (1 k roving) can preferably be spread such that two rovings are placed at least at the width of the later filament. The distance of the rovings in this context is defined by the geometry of the filament. For example, with a filament of 10 mm in width, one roving is placed at a distance of 2 mm and one roving at a distance of 8 mm from the left edge of the filament. This attains an ideal combination of increased resistance to pull of the material and a still slight increase of the conductivity of the filament.

The mixture is then dried, if required, and thermally consolidated afterwards. During consolidation, the poured-out material and the carbon fibers possibly placed underneath and above it are heated first (preferably by infrared radiation) rendering the plastic fraction, consisting of thermoplastic material in the present case, deformable, and this is pressed together between hot rollers to which pressure is being applied right after the heating process.

The starting material is then used to cut the filaments to the desired width and length.

The further processing is analogous to exemplary embodiment 1, but special diligence should be devoted to a parallel orientation of the reinforcing carbon fibers with respect to the direction of pull. Moreover, the cutting in longitudinal direction should proceed exactly parallel to the reinforcing carbon fiber rovings.

Exemplary Embodiment 5

In order to produce the filament, a non-woven material which is additionally reinforced with through-going carbon fibers is produced. Then, filaments of the desired dimensions are cut from the reinforced material thus produced.

The non-woven material consists of carbon fibers cut to 3-12 mm in length and fibers made of a thermoplastic material, PEEK in the present case, cut to approximately the same size. PET can be used just as well, but it may then be necessary to select a different ratio of carbon fibers to thermoplastic fibers.

The carbon fibers and the plastic fibers, in the form of thermoplastic fibers in the present case, are then distributed simultaneously and homogeneously onto a surface. The homogeneous distribution is attained, e.g., using a shaker distributing the fibers onto an unreeling tape. The shaker preferably has a track width of 300 mm. In this context, the carbon fibers and the thermoplastic fibers are preferably (a) distributed over the surface at a homogeneous density, such that the distribution of thermoplastic fibers and carbon fibers is homogeneous even on a small scale, and (b) distributed over the surface, such as to mix with each other and cover each other. Distinct layers of carbon fibers and plastic fibers arranged one above the other and not homogeneously mixed with each other should not be formed on the surface. In this context, a homogeneous distribution even on a small scale is to mean that a homogeneous distribution preferably on a surface of 10 mm×10 mm, more preferably 4 mm×4 mm, is to be evident.

The later electrical properties of the electrically conductive material are defined in this processing step. The electrical conductivity can be adjusted in this context, inter alia, by the weight per unit area, i.e., the mass per unit area of consolidated material, the number of contact sites of carbon fibers to each other per unit area, and via the volume fraction of plastic fibers in the consolidated mixture. The fewer mutual contact sites of carbon fibers are present and the higher the fraction of plastic fibers, the higher will be the resistivity of the electrically conductive material.

The consolidated mixture is then dried, if required, and thermally consolidated afterwards. During consolidation, the poured-out material is heated first, which is preferably effected by infrared radiation. This renders the fraction of the mixture accounted for by plastic fibers, consisting of thermoplastic material in the present case, deformable, and this is pressed together between hot rollers, to which pressure is being applied right after the heating process.

One or more layers of carbon fibers can now be introduced between layers made of the non-woven material by guiding one or more carbon fiber rovings through a broad, fine comb, such that the fibers are distributed largely parallel to each other onto a larger surface. The layer of carbon fibers thus obtained has, seen over its width, many fibers arranged next to each other, wherein its thickness is a result of single or few carbon fibers arranged over each other.

The material thus arranged is then subjected to thermal consolidation again.

The starting material is then used to cut the filaments to the requisite width and length.

The further processing is analogous to exemplary embodiment 1, but special diligence should be devoted to a parallel orientation of the reinforcing carbon fibers with respect to the direction of pull. Moreover, the cutting in longitudinal direction should proceed exactly parallel to the reinforcing rovings.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the invention as defined by the appended claims.

We claim:

1. A method for manufacture of an electrically conductive material, the method comprising the steps of:

a) providing a carbon fiber;

b) providing a plastic fiber that differs from the carbon fiber;

c) producing a mixture in a form of a two-dimensional mat from the carbon fiber and the plastic fiber; wherein the mat comprises a multitude of single fibers that are deposited at random;

d) optionally drying the mixture;

e) consolidating the mixture;

f) optionally cutting the mixture to size; and g) carbonizing the mixture, wherein the carbonized plastic fibers form a carbon-based matrix possessing electrical conductivity that at least partially surrounds the carbon fibers.

2. The method according claim 1, wherein a mass fraction of carbon fibers, relative to the mixture, is from 1 mass % to 70 mass %.

3. The method according to claim 1, wherein a fiber weight per unit area of the consolidated mixture is 75 $g/m^2$ to 500 $g/m^2$.

4. The method according to claim 1, wherein a length of the carbon fibers and plastic fibers in the mixture differs by maximally 50% relative to the length of the carbon fibers.

5. The method according to claim 1, wherein a length of the carbon fibers or of the plastic fibers or both in the mixture is from 3 mm to 30 mm.

6. The method according to claim 1, wherein the plastic fibers contain a thermoplastic material.

7. The method according to claim 6, wherein thermoplastic material contains a material selected from polyethersulfone (PES), polyetheretherketone (PEEK), polyetherimide (PEI), polyethyleneterephthalate (PET), polyphthalamide (PPA), polyphenylenesulfide (PPS), polyimide (PI), and mixtures of at least two of these.

8. The method according to claim 1, wherein another plastic fiber made of duroplastic material is used in addition to the plastic fiber made of thermoplastic material.

9. An electrically conductive material comprising a composite that contains:

a) a first carbon fiber and a further carbon fiber; and b) a matrix that partly surrounds the first carbon fiber and the further carbon fiber each, wherein the electrical conductivity of the matrix is lower than that of the carbon fibers;

wherein, with respect to a sectional plane through the composite, of a total number of carbon fibers extending through the sectional plane, more than 20% of the carbon fibers extending through the sectional plane do not contact any other carbon fiber extending through the same sectional plane.

10. The electrically conductive material according to claim 9, wherein the sectional plane is oriented to be orthogonal to a possible direction of current flow through the material.

11. The electrically conductive material according to claim 9, having at least one of the following properties:

i. the matrix has a defined specific electrical conductivity;

ii. the matrix defines an orientation of the carbon fibers;

iii. the matrix defines a specific number of contact sites between carbon fibers (3); and iv. the carbon fibers are distributed and/or oriented in the matrix in appropriate manner, such that a current flow through the material is forced to proceed at least through a portion of the matrix.

12. An emitter comprising:

a) a transparent or translucent housing; and b) an electrically conductive material according to claim 9, arranged in the housing.

13. The emitter according to claim 12, wherein the electrically conductive material has appropriate flexibility, such that the electrically conductive material can be bent into a circle and over its entire length about a radius of 1.0 m, without fracturing the carbon fibers and/or the matrix and/or without separating the carbon fibers and the matrix.

14. The emitter according to claim 13, wherein the flexibility is such that the electrically conductive material can be bent into a circle and over its entire length about a radius of 0.25 m, without fracturing the carbon fibers and/or the matrix and/or without separating the carbon fibers and the matrix.

15. The emitter according to claim 12, wherein the electrical conductivity of the electrically conductive material, measured as electrical operating voltage per unit of length of the electrically conductive material, exceeds 150 V/m.

* * * * *